US007207852B2

(12) United States Patent
Myers

(10) Patent No.: US 7,207,852 B2
(45) Date of Patent: Apr. 24, 2007

(54) SHIP PROPULSION ARRANGEMENT

(75) Inventor: Timothy Mark Stephen Myers, Newcastle Upon Tyne (GB)

(73) Assignee: Rolls-Royce PLC, London (GB)

( * ) Notice: Subject to any disclaimer, the term of this patent is extended or adjusted under 35 U.S.C. 154(b) by 0 days.

(21) Appl. No.: 11/046,233

(22) Filed: Jan. 31, 2005

(65) Prior Publication Data

US 2006/0079141 A1 Apr. 13, 2006

(30) Foreign Application Priority Data

Feb. 18, 2004 (GB) ..... 0403557.2

(51) Int. Cl.
*B63H 21/20* (2006.01)

(52) U.S. Cl. ..... 440/3; 310/87; 440/6

(58) Field of Classification Search ..... 440/3, 440/4, 6, 75, 83; 310/87
See application file for complete search history.

(56) References Cited

U.S. PATENT DOCUMENTS 2,714,866 A * 8/1955 Pleuger et al. ..... 440/6
3,703,642 A * 11/1972 Balaguer ..... 440/6
4,831,297 A * 5/1989 Taylor et al. ..... 440/6
4,938,723 A * 7/1990 Yoshimura et al. ..... 440/83
5,185,545 A * 2/1993 Veronesi et al. ..... 440/6
5,597,245 A * 1/1997 Meyerhoff ..... 440/6
5,616,056 A 4/1997 Meissner ..... 440/3
6,231,407 B1 5/2001 Hein et al. ..... 440/6
6,312,298 B1 * 11/2001 Schuring ..... 440/6

FOREIGN PATENT DOCUMENTS

EP 0 117 881 A1 9/1984
GB 2 378 691 A 2/2003

* cited by examiner

*Primary Examiner*—Lars A. Olson
(74) *Attorney, Agent, or Firm*—Oliff & Berridge PLC

(57) ABSTRACT

A ship propulsion arrangement is provided in which a mechanical drive shaft (3) extends through a hull (9) of a ship (1) to an external body (7). The external body incorporates an electric motor. The mechanical drive shaft (3) is driven when required by either a prime mover (2) located within the ship (1) or by the electric motor in the external body (7). This arrangement provides the benefits of hybrid operation without necessary accommodation of the electric motors within the limited hull space available in a ship (1).

10 Claims, 2 Drawing Sheets

SHIP PROPULSION ARRANGEMENT

The present invention relates to ship propulsion arrangements and more particularly to ship propulsion arrangements of a so called hybrid type where a prime mover is used to possibly directly propel a ship or in combination with other prime movers drive an electrical generator for electric motors which propel the ship.

There are clear advantages in operating any machinery in the most efficient manner possible to meet the desired performance and operational requirements of that machinery. Ship efficiency is normally assessed in terms of fuel consumption and wear and tear as well as maintenance/servicing intervals for the engines propelling that ship. Generally, an engine used as the prime mover for propulsion of the ship will have certain operational conditions which provide optimised performance in terms of emissions and fuel consumption, etc. Unfortunately, the load placed upon those engines will depend upon how quickly the ship needs to be propelled and any resistance to such propulsion in terms of weather conditions and load, etc. Furthermore, with regard to some ships, the desired range of operational performance may vary considerably. For example with naval ships during non operational periods, lower speeds are acceptable for cruising, and it is desirable to achieve high range through better fuel economy whilst during operational periods clearly the full and maximum range of propulsion speeds, etc should be available.

In view of the above it is known to provide so called hybrid propulsion systems in which a high power prime mover such as a gas turbine engine or diesel engine, for sprint propulsion is directly coupled to the propeller in a conventional manner is combined with a second lower power but more economical prime mover which drives electric motors via an electric generator. The prime mover engines can then be normally operated at their respective most efficient levels in terms of fuel consumption, etc. In short, by a combination of direct propulsion through a propeller shaft to the prime mover and propulsion through electric motors, the most efficient operation of the ship can be achieved. The lower power prime mover generator and electric motors typically provide the propulsive power for the ship sufficient for day to day operations, in a fuel efficient manner whilst during short duration high speed sprints the mechanically coupled high power prime mover is used to maximise ship speed, etc.

Despite the advantages described above it will be appreciated that ships also have limited available compartment space for additional machinery, and such machinery itself may alter weight distribution within a ship adversely. In such circumstances use of hybrid technology on ships for naval applications below 6,000 tonnes is difficult and, generally towards the upper end of this range, expensive bespoke electric motors are required to meet the accommodation constraints and other matters.

In accordance with the present invention there is provided a mechanical ship propulsion arrangement comprising a mechanical drive shaft which extends through a hull of a ship to an external body incorporating an electric motor for ship propulsion whereby the electric motor drives the shaft when required.

In the preferred embodiment of the present invention the mechanical drive shaft is driven when required by either a prime mover located within the ship or the electric motor in the external body.

A clutch may be provided to selectively engage and disengage the drive shaft to either the prime mover or the electric motor.

Normally, the electric motor is driven by an electrical generator coupled to a prime mover such as a diesel or gas turbine engine. Generally, the external body is a hydrodynamic pod. Possibly, the external body lies directly upon an external surface of the hull. Alternatively, the external body is secured to the hull through projecting pylons. Further alternatively, the external body is secured along the principal axis of the hull at the stern of that hull.

Preferably, the electric motor is located about the mechanical drive shaft. Alternatively, the electric motor is located about a propeller and is secured in a cowl over the propeller to provide a propeller rim drive.

Normally, the external body is an integral unit discretely attachable and detachable as required from the hull. Furthermore the integral unit is of a standard modular type readily exchanged for maintenance or service or alteration in ship propulsion arrangement performance capabilities.

Typically, the mechanical drive shaft extends through a seal in the hull to present a coupling for the external body.

Also, in accordance with the present invention there is provided a ship incorporating a ship propulsion arrangement or an external body as described above.

Embodiments of the present invention will now be described by way of example and with reference to the accompanying drawings in which.

Hybrid propulsion systems and arrangements are used in a number of ships in particular ships for naval operations. Such hybrid propulsion arrangements are used to maximise the propulsion and prime mover plant efficiency and flexibility. Briefly, an electric drive motor, driven through its own prime mover and electrical generator, provides a part of the propulsion power, generally enough for day to day operations and, for transit to a theatre of operations in the most fuel efficient manner. However, when short duration high speed "sprints" are required an additional mechanically coupled high power prime mover is used to give ship speeds up to a maximum. This maximum speed may be achieved by using the high power prime mover alone or in combination with the electric motor(s) and their prime mover/generator combinations. Generally space for electric motors is restricted in small ships and so can result in hybrid propulsion arrangements being practically unavailable to a ship designer or for that designer to need expensive bespoke machinery for specific classes of vessel with associated cost penalties.

The present invention relates to providing an externally mounted electrical drive motor which is coupled to the same mechanical drive shaft as for the high power prime mover for sprint propulsion, but in all other respects does not claim any accommodation space within the hull of that ship. In such circumstances, the main propulsive mechanism typically in the form of an engine/gearbox from which the mechanical drive shaft drives a propeller is used as a drive train upon which the electric motor acts to itself drive propulsion when required. Clearly, in such circumstances accommodation of an external body which is substantially self contained apart from coupling to an electrical power source within and to the mechanical drive shaft of the ship avoids difficulties with respect to accommodation of the electric drive motor/hybrid operation within the ship's own hull. This has particular benefits with regard to relatively small naval ships, that is to say below 6,000 tonnes.

Figure 1:
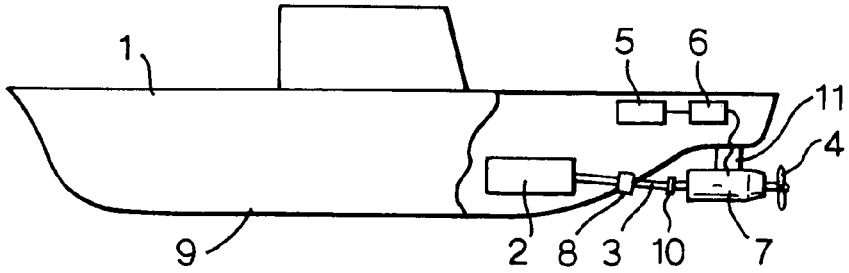
FIG. 1 is a schematic side cross section of a ship propulsion arrangement of a pusher type in accordance with the present invention.

FIG. 1 is a schematic cross section of a ship 1 incorporating a propulsion arrangement in accordance with a 'pusher' type embodiment of the present invention. The arrangement comprises a high power prime mover 2 from which a mechanical drive shaft 3 extends to a propeller 4 for high or full speed range mechanical propulsion of the ship 1. In accordance with the present invention a lower power prime mover 5 through an electrical power coupling 6, provides electrical power to an external body 7 incorporating an electric motor (not shown) which in turn drives the shaft 3 for propulsion of the ship 1 when required. The body 7 is connected to the hull of the ship to anchor the body 6 for reaction force in order to cause operation of the motor to turn the shaft 3. A conventional seal 8 is provided across the hull 9 In such circumstances within inherent physical limitations, the external body 7 can be associated with a wide range of ship sizes and in particular smaller ships than previously amenable to hybrid propulsion. Clearly, as indicated the external body 7 should be coupled to the ship 1 through the hull 9 for mounting purposes as well as to provide electrical power transfer.

The external body 7 as indicated incorporates an electric motor in order to drive the mechanical shaft upon which the propeller 4 is located. Typically, the external body 7 is secured to the hull 9 through a pylon 11 beneath the ship 1. This pylon 11 ensures that operation of the electric motor within the external body 7 causes rotation of the propeller 4. In such circumstances the pylon 11 should have sufficient structural integrity to withstand loadings placed on it by the external body 7 due to the weight of that body 7 as well as reaction forces created by mechanical driving through the prime mover 2 and shaft 3 and through operation of the electric motor within the external body 7.

Figure 2:
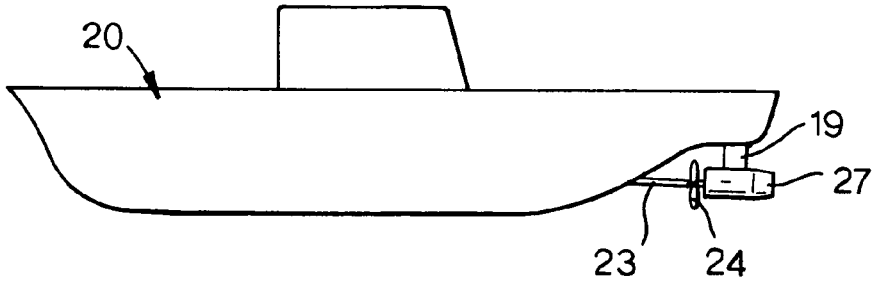
FIG. 2 is a schematic side view of a ship propulsion arrangement of a puller type in accordance with the present invention.

FIG. 2 illustrates a "puller" embodiment of the present invention. Thus, a ship 20 is provided with a propulsion arrangement similar to that described previously, such that a mechanical drive shaft 23 is coupled to a propeller 24 such that the propeller 24 can be driven either from a high power prime mover (not shown) within the ship 20 or through an electric motor (not shown) in an external body 27 secured through a pylon 19 to the ship 20. As previously the electric motor within the external body 27 receives electrical power from an electrical generator and electrical power coupling within the ship 20 which in turn is powered by a more economical prime mover or prime movers. In the pusher embodiment depicted in FIG. 2, the electric motor within the external body 27 acts upon an extension of the drive shaft from the propeller 24 in order to create rotation of the propeller 24 and therefore propel the ship 20. In such circumstances it can be perceived that the propeller 24 when driven by the electric motor in the external body 27 is pulling the ship 20 rather than the more conventional pushing configuration showed in FIG. 1.

The principle of the present invention is the inclusion of an externally mounted electric motor in a separate external body operating on the same mechanical drive shaft as the main or high power mechanical prime mover/propeller combination. Electrical power to the electric motor is provided through electrical cables which are fed from a second or several other smaller prime movers/generator combinations which will typically form part of a ship's electrical system or an upgrade of that electrical system or be independent prime movers utilised specifically for this task, although this too may create accommodation problems itself in the hull of a small ship.

Figure 3A:
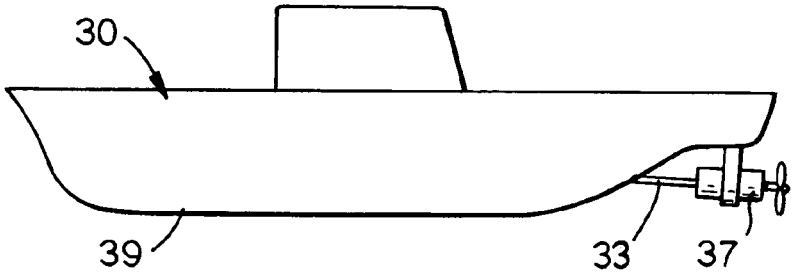
FIG. 3 is a schematic side view of a ship propulsion arrangement in which an A-frame support has been modified in accordance with the present invention; and, FIG. 4 is a schematic side view of a slip propulsion arrangement of a propeller rim drive type in accordance with the present invention; and, FIG. 5 is a schematic cross-section of an external body in accordance with the present invention.
Figure 3B:
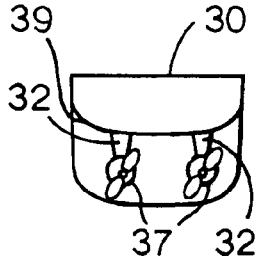

As indicated above, the weight and reaction forces imposed by the external body in terms of its weight and electric motor can be significant. In such circumstances, as illustrated in FIG. 3, it may be convenient to replace any conventional shaft steadying bearings for a mechanical drive shaft with a larger external body incorporating an electrical motor propulsion arrangement in accordance with the present invention. Thus, as illustrated in FIG. 3*a,* a ship 30 has a mechanical drive shaft 33 driven by a high power prime mover within that ship 30. An external body 37 is secured upon the shaft 33. This external body 37 incorporates an electric motor in a propulsion arrangement in accordance with the present invention. This electric motor is supplied by electrical power from the ship's existing systems or a specific combination of prime movers/electrical generators within that ship 30. As can be seen in FIG. 3*b,* the ship 30 has two mechanical drive shafts in a so called two screw situation. Each mechanical drive shaft has its own external body 37 secured upon a pylon 32. These external bodies 37 incorporating electric motors constitute significant additional weight secured upon the bottom of the ship's hull 39, thus the pylons 32 which generally take the form of an A-frame will be modified in order to accommodate the external bodies 37 as an additional feature or the electric motors themselves will be accommodated within the existing pylon 32 structure as required, to define an external body in accordance with the present invention.

Figure 4:
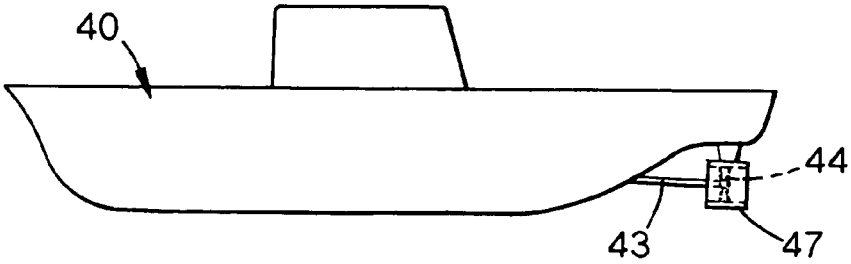

FIG. 4 illustrates a further potential embodiment of the present invention in which a ship 40 again incorporates a high power prime mover to deliver propulsion through a mechanical drive shaft 43 to a propeller 44. About the rim of the propeller 44 an external body 47 is provided within which an electrical motor is formed. Thus, the embodiment depicted in FIG. 4 is of a so called propeller rim drive type. The electric motor in the external body 47 is supplied with electrical power through a coupling in the ship 40 and a pylon 42.

Figure 5:
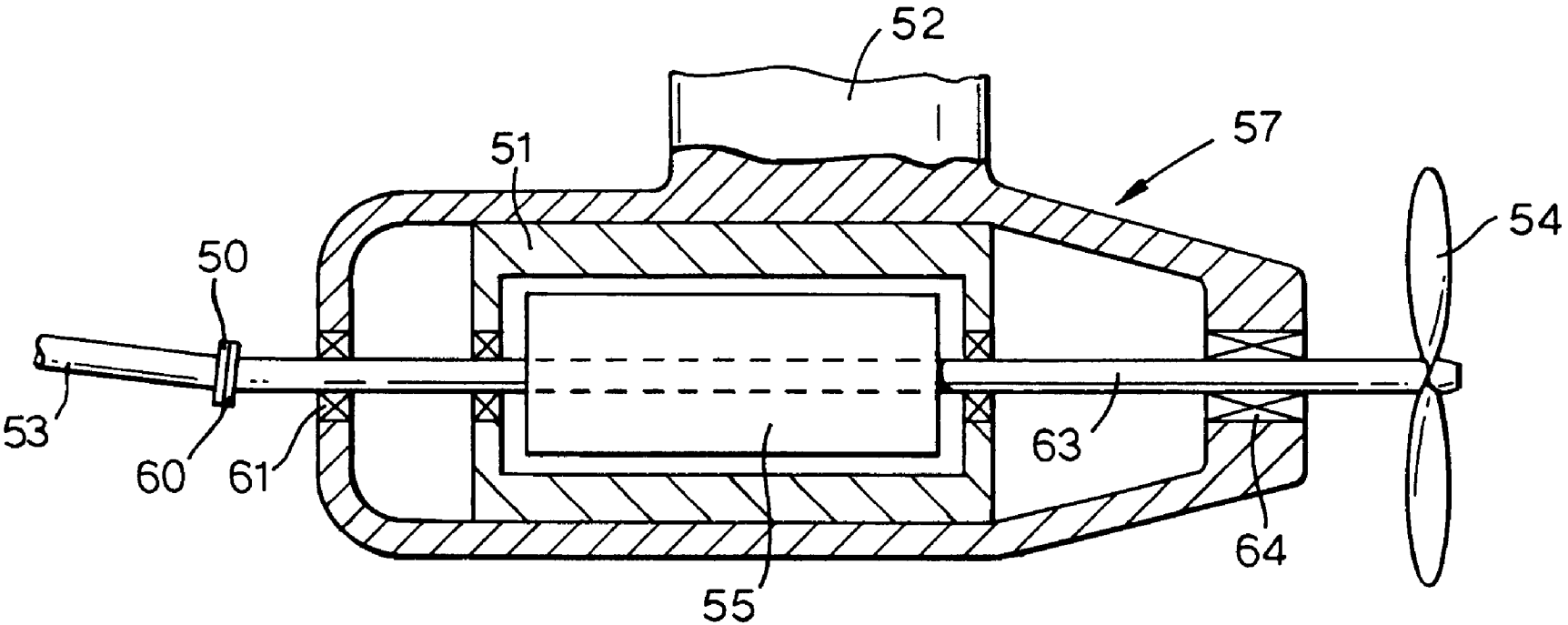

FIG. 5 illustrates a schematic cross-section of an external body 57 in accordance with the present invention. The external body 57 is a hydrodynamic pod incorporating a shaft 63 which extends to a propeller 54 at one end and a coupling 60 at the other. The external body 57 is secured upon a pylon 52 which extends to the ship's hull (not shown).

For conventional operation, a mechanical drive shaft 53 extends to a coupling 50 which is then secured to the coupling 60 in order that the drive shafts 53, 63 are mechanically coupled in order to drive the propeller 54 and therefore the ship. It will be understood that the mechanical drive shaft 53 is secured to a high power prime mover to enable full speed range operation and in particular "sprint" speed. An electrical motor formed by a stator 51 and a rotor 55 acts upon the shaft 63. The rotor 55 is secured to the shaft 63 such that in accordance with typical electric motor operation, rotation of the shaft 63 is achieved in order to drive the propeller 54. Electrical power for the electrical motor is provided through the pylon 52.

The external body 57 generally only contains the electric motor and necessary bearings (not shown) for the shaft 63. When required the propeller 54 can be driven solely by the high powered prime mover through the mechanical drive shaft 53 or via the electric motor on its own for more economical operation or where possible by a combination of the two. In such circumstances, best utilisation of the respective prime movers for required current operational necessities can be achieved.

It will be understood in order to limit potential drag upon the mechanical drive shaft that means such as a clutch may be provided to disengage the high powered prime mover when the shaft is driven by the electric motor in the external body. In such circumstances, although the same mechanical drive shaft is used for the high powered prime mover and the other prime movers used for electrical generation of electrical power for the electric motor in the external body or bodies such operation can be optimised for particular situations.

It should be understood that the geometric configurations depicted in FIGS. 1 to 4 are merely given as examples and a wide range of differing positions for the external bodies in accordance with the present invention may be provided within the confines of ship stability, provision for coupling a mechanical drive shaft and electrical cabling and expected operational requirements.

Inherent to the principle of hybrid ship propulsion arrangements is the use of the same mechanical drive shaft for both the high power prime mover and an electric motor in an external body powered by electrical power from a separate more economical prime mover/generator combination. Typically, a ship will incorporate a high power prime mover in the form of a diesel engine or gas turbine which is operated under best fuel efficiency conditions and possibly emissions in order to provide sprint speed capability by mechanical propulsion as required through the shaft to the propeller. Particularly, with regard to naval ships there may also be further smaller lower power prime mover(s) in the form of a diesel or gas turbine engine which will generate electricity and/or provide for long term cruise speed propulsion of the ship through the same mechanical drive shaft and propeller as for sprint operations, but using an electric motor to turn the shaft.

In the above circumstances external bodies in accordance with the present invention basically incorporate at least an electric motor in order to provide their propulsive component for the ship. The means for generating electricity will be on board the ship and electricity then supplied to the electric motor in the external body through electrical cabling. The benefits of a hybrid propulsion arrangement are operation of the respective prime movers at their optimum efficiency conditions such that any losses in terms of converting the prime movers force into electrical energy and transmission losses to the electric motor in the external body are offset by the greater efficiency of operation of the prime movers. Normally, a ship will incorporate means for electrical generation for other operations such as lighting, instrumentation and steerage so that on board electrical generation machinery may require simply upgrading in order to provide electrical power for electric motors in external bodies in accordance with the present invention.

As described above, the external bodies in accordance with the present invention will be typically shaped in order to be consistent with hydraulic flow over the ship and external body profiles. It will be understood that the external bodies will typically add flow resistance to the ships profile, but by appropriate shaping and configuration this may be minimised by rendering them as hydrodynamic as possible.

Bespoke hybrid electric motor accommodation within the ships hull will no longer be required as the external body is a substantially integral and independent unit other than with regard to electrical cabling through the ship's hull.

I claim:

1. A mechanical ship propulsion arrangement comprising a mechanical drive shaft which extends through a hull of a ship to drive a propulsion propeller housed in an external body incorporating an electric motor for ship propulsion, a first prime mover located within the hull for driving the mechanical drive shaft directly, and a second prime mover located within the hull for driving an electrical generator to supply electric power to operate the electric motor in the external body.

2. An arrangement as claimed in claim 1 wherein the mechanical drive shaft is driven when required by the first prime mover located within the ship and the electric motor in the external body.

3. An arrangement as claimed in claim 1 wherein the electric motor is driven by an electrical generator coupled to the second prime mover.

4. An arrangement as claimed in claim 1 wherein the external body is a hydrodynamic pod.

5. An arrangement as claimed in claim 1 wherein the external body lies directly upon an external surface of the hull.

6. An arrangement as claimed in claim 1 wherein the external body is secured to the hull through projecting pylons.

7. An arrangement as claimed in claim 1 wherein the external body is secured along the principal axis of the hull at the stern of that hull.

8. An arrangement as claimed in claim 1 wherein the external body is an integral unit discretely attachable and detachable as required from the hull.

9. An arrangement as claimed in claim 1 wherein the mechanical drive shaft extends through a seal in the hull to present a coupling for the external body.

10. A ship including a ship propulsion arrangement as claimed in claim 1.

* * * * *